US007073975B2

(12) United States Patent
Kraemer

(10) Patent No.: US 7,073,975 B2
(45) Date of Patent: Jul. 11, 2006

(54) SLOT CUTTING APPARATUS AND METHOD

(75) Inventor: Terrence L. Kraemer, St. Cloud, MN (US)

(73) Assignee: Diamond Surface, Inc., Maple Grove, MN (US)

( * ) Notice: Subject to any disclaimer, the term of this patent is extended or adjusted under 35 U.S.C. 154(b) by 11 days.

(21) Appl. No.: 10/793,166

(22) Filed: Mar. 3, 2004

(65) Prior Publication Data

US 2005/0196240 A1 Sep. 8, 2005

(51) Int. Cl.
*E01C 23/16* (2006.01)

(52) U.S. Cl. ..... 404/85; 404/94; 299/39.3

(58) Field of Classification Search ..... 404/94, 404/85; 299/39.3, 33, 39.5
See application file for complete search history.

(56) References Cited

U.S. PATENT DOCUMENTS

| | | | | | |
|---|---|---|---|---|---|
| 193,171 | A * | 7/1877 | McRae | ..... | 299/39.3 |
| 2,502,043 | A * | 3/1950 | Howard | ..... | 299/39.3 |
| 2,791,442 | A * | 5/1957 | Lee et al. | ..... | 280/410 |
| 3,572,842 | A * | 3/1971 | Mori | ..... | 299/39.4 |
| 3,649,071 | A * | 3/1972 | Graff | ..... | 299/41.1 |
| 3,767,264 | A * | 10/1973 | Eckey | ..... | 299/39.5 |
| 3,901,553 | A * | 8/1975 | Binger et al. | ..... | 299/39.3 |
| 4,067,398 | A * | 1/1978 | Franzen et al. | ..... | 173/193 |
| 4,346,766 | A * | 8/1982 | Manten | ..... | 173/189 |
| 4,792,190 | A * | 12/1988 | Bertrand | ..... | 299/41.1 |
| 4,909,575 | A * | 3/1990 | Lupton | ..... | 299/39.5 |
| 6,206,478 | B1 * | 3/2001 | Uehara et al. | ..... | 299/33 |
| 6,612,773 | B1 * | 9/2003 | Gray | ..... | 404/94 |

* cited by examiner

*Primary Examiner*—Gary S. Hartmann
(74) *Attorney, Agent, or Firm*—Merchant & Gould P.C.

(57) ABSTRACT

An apparatus for cutting slots in pavement has a slot cutting assembly with several pairs of rotating blades mounted to a vehicle and vertically adjustable relative to the vehicle. A lift system moves the vehicle between a first position wherein the lift is not engaging the ground and a raised position wherein the lift engages the ground. A slider assembly uses a hydraulic to move the vehicle horizontally on rails relative to the lift when the vehicle is at the raised position. In operation, the vehicle is lifted and the cutting assembly lowered so the blades engage the pavement. The vehicle slides back and forth on the rails as the blades cut slot pairs. The material between each slot pair is removed to form a recess receiving reinforcement devices.

13 Claims, 6 Drawing Sheets

SLOT CUTTING APPARATUS AND METHOD

BACKGROUND OF THE INVENTION

1. Field of the Invention

The present invention is directed to a slot cutting apparatus and method, and in particular to a slot cutting apparatus and method for cutting slots to form recesses across joints in pavement to repair faults and/or reinforce the pavement.

2. Prior Art

Slots are formed in pavement joints to define sides of a recess into which reinforcement devices are inserted to attach the pavement sections on either side of the joint. Such pavement joint reinforcement devices are well known and have been widely used for several years. Premature fatigue at the contraction joints is known as faulting and is repaired through load transfer restoration to improve the pavement strength across the joint and to slow down future fault development. A pair of aligned slots are cut in the pavement and the material between the slots is removed to form a recess. In some cases, reinforcement across the joint never existed, while in others, replacement is necessary. The dowels anchor to both pavement sections and improve load transfer across the joint. Dowels are conventionally placed in the recesses formed in both portions of the pavement and backfill material is placed in the recess to anchor the dowels. The support dowels and their effectiveness are improved by a strong bond between the reinforcement device in the recess and the pavement walls of the recess.

As several recesses are formed along each joint to receive a corresponding number of reinforcement devices, and as there are large numbers of joints along roads, the process for cutting slots is a time consuming one. The slot cutting process typically involves diamond impregnated blades cutting pairs of slots forming recess sidewalls with a pair of aligned spaced apart blades. The material between the two cuts is removed to form a recess. Further challenges arise when attempting to align the cuts and provide a clean cut. Where the surface of the road is not level, the blades are often subject to lateral pressure as the cutting machine is moved forth and back causing wear to blades, bearings and other components.

In an effort, to overcome this problem, a cutting machine has been developed that locks the frame with only its cutting head moving relative to the frame. Although this may overcome some of the lateral pressure problems, it has several shortcomings. By using only the cutting head rather than the entire vehicle, the mass moving back and forth and the pressure applied to the pavement is relatively small. The momentum and mass of the cutting machine is not fully used as an advantage. A cutting apparatus and method that eliminates side pressure during cutting, yet uses the mass of the cutting device, rather than just a cutting assembly, would improve slot quality and prolong equipment life.

It can be seen then that a new and improved cutting apparatus and method is needed for cutting slots and to repair and replace reinforcement devices across contraction joints. Such an apparatus and method should provide for proper alignment of slots at both sides of the recesses and for cutting without damaging the bearings or the saw blades. Such an apparatus and method should also provide for using the full mass and momentum of a cutting vehicle to make the cuts, rather than just the mass and momentum of a cutting blade assembly. Slots of varying lengths and depths should be possible and should be made while maintaining the slots in alignment with one another. The present invention addresses these as well as other problems associated machines and methods for forming slots across pavement joints.

SUMMARY OF THE INVENTION

The present invention is directed to a pavement slot cutting apparatus and method for cutting slots in pavement. The cutting apparatus is a vehicle with a slot cutting assembly mounted thereto. The vehicle includes a frame and body and wheels driven by an engine. The engine provides power to the various systems and a cab includes controls for the various vehicle systems and allows the operator to clearly view the cutting operation and to steer the vehicle from one location. The vehicle also includes a lift assembly to raise the vehicle for precise cutting by providing back and forth movement along rails associated with the lift system. The slot cutting assembly has a plurality of cutting blades mounted in parallel on the vehicle and its position can be vertically adjusted for making pavement cuts of varying depths.

According to the present invention, a lift system lifts the entire vehicle frame and chassis off the ground so that locking the wheels is not necessary, as was done in some prior art systems. The lift system supports the vehicle on legs, which are not locked, but do not roll or slide, so there is no need to lock the cutter. The lift system also supports a slider system with rails extending along the direction of travel so that the vehicle slides back and forth on the rails when lifted. A hydraulic ram moves the cutter back and forth relative to the lift when making cuts, as explained hereinafter.

The cutting operation begins by raising the vehicle. While the vehicle is raised, the cutting assembly supported at the front of the vehicle is lowered to engage the pavement. The vehicle then moves back and forth, rolling on the rails of the slider assembly. As the cutting blades are at a lowered position below the pavement surface, they form slots in the pavement across the joint. The cutting assembly may be lowered to a deeper position for successive cuts and may cut both forward and backward passes along the rail. Moreover, the travel distance on the rails can be preset to achieve a consistent slot length. When the slots are finished, material between slot pairs is removed in a conventional manner to form a recess. Each of the recesses receives reinforcement components and is later filled to provide the proper reinforcement to the joint. Problems that may occur with prior art devices due to slippage of a lock or other unintended movement are overcome with the present invention. Moreover, the mass of the entire vehicle, including the motor, frame and body, is utilized, rather than locking a frame and moving just a cutting carriage, as was done with some prior art devices.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

DETAILED DESCRIPTION OF THE PREFERRED EMBODIMENT

Figure 1:
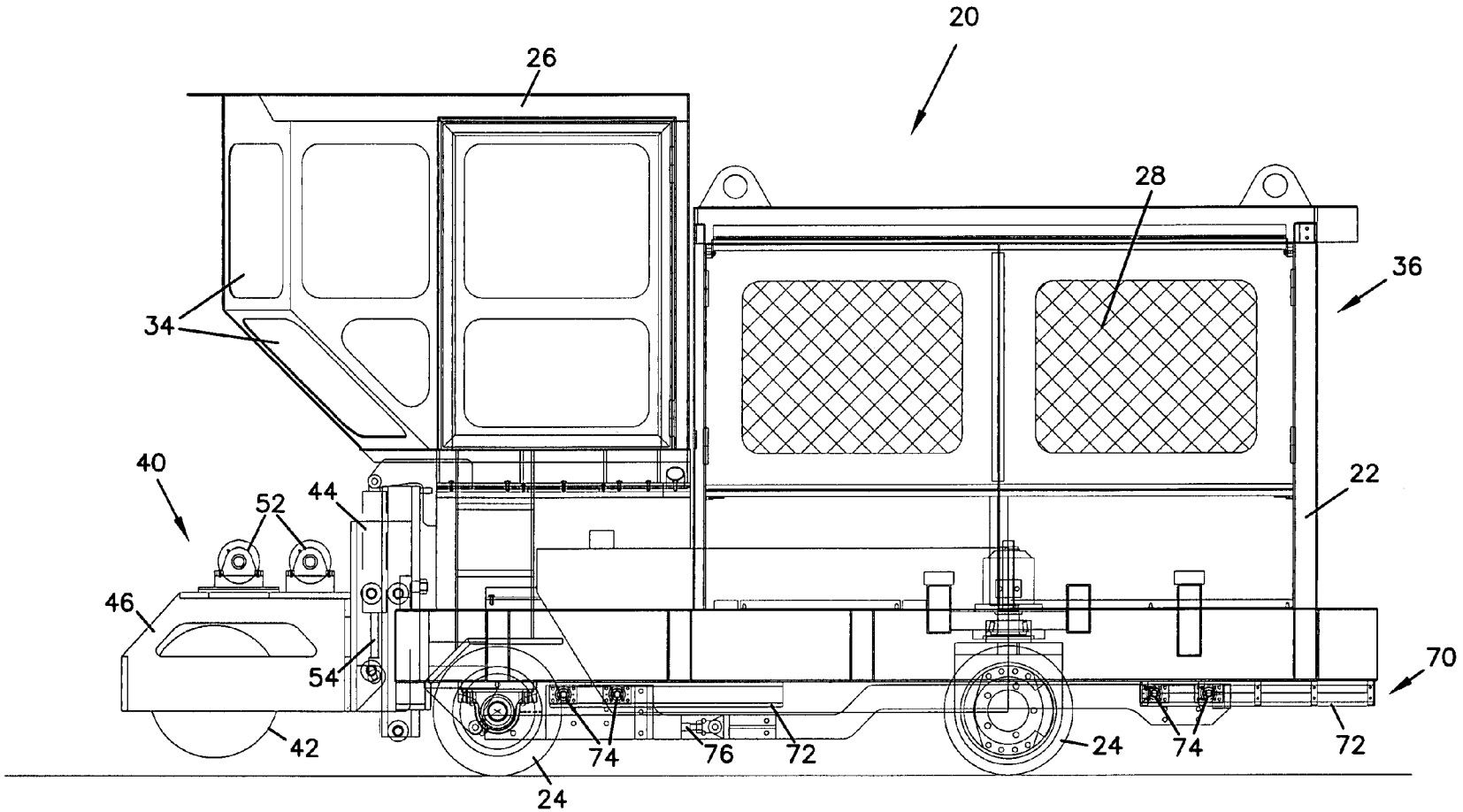
FIG. 1 is a side elevational view of a slot grinding apparatus according to the principles of the present invention.
Figure 7:
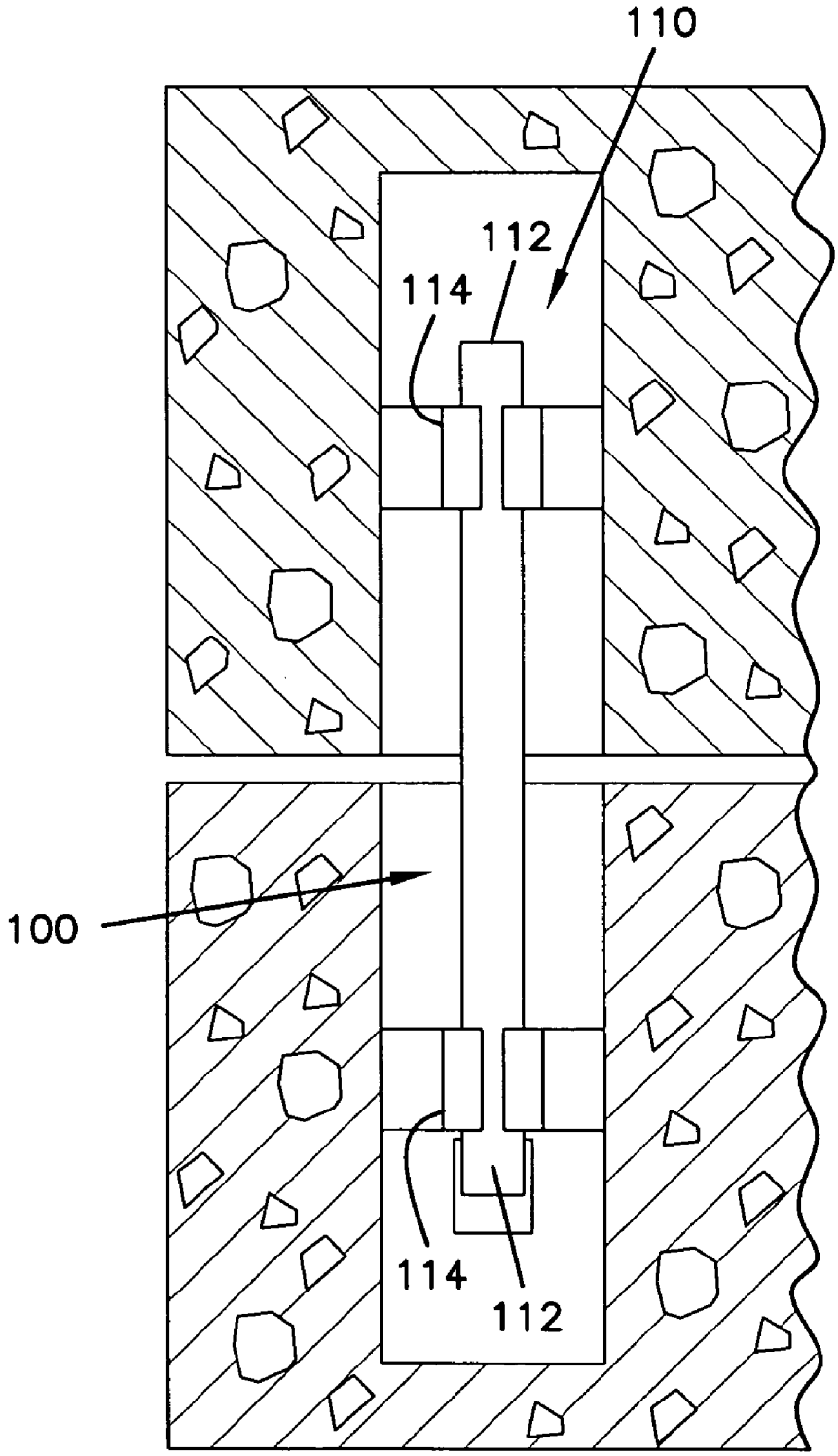
FIG. 7 is a top plan view of a pavement joint with a recess and reinforcement device.

Referring now to the drawings and in particular to FIG. 1, there is shown a cutting apparatus or cutter, generally designated 20, for cutting slots into pavement. More particularly, the cutter 20 is configured for cutting slots at joints to form recesses that receive components to provide reinforcement to worn sections of the pavement. The sections of pavement with the highest wear are typically those areas below the normal path of travel for the tires of vehicles and particularly, heavier vehicles such as tractor-trailers. The sides of the recesses are made with the cutting apparatus 20 and the material between the side cuts is removed with jackhammers or other tools, using conventional techniques that are well known in the art. Reinforcing devices 110 are placed in the recesses 100 as shown in FIG. 7, which are then filled back up to the level of the road surface. Such conventional reinforcing devices 110 and techniques are well known in the art and utilize a dowel 112 or other structure anchored at each end extending across the joint. The dowel 112 is generally lifted off the bottom of the recess 100 by supports 114 and the fill material 116, such as concrete, is deposited in the recess 100 and flows around the dowel 112 to securely anchor it to the pavement.

Unlike the prior art devices wherein the cutting apparatus is locked and only a small carriage is moved back and forth, the cutting apparatus 20 includes a chassis with a frame and body 22 that moves back and forth to form the slots, as explained hereinafter. The cutter 20 includes wheels 24 for transport when the cutter 20 is not cutting. The cutter 20 also includes a cab 26 for an operator at the front portion of the cutting apparatus. The cab 26 includes the controls and viewing windows 34 including lower forward angled windows that allow an operator to view the cutting operation from the same location used for steering. An engine 28 provides power for moving the cutter 20, for powering a cutting assembly 40, and for sliding the cutter 20 when lifted, as explained hereinafter. To the rear of the cab 26 is a slurry system 36. The slurry system 36 directs water to the cutting assembly and aids in cooling as well as containing dust and debris. Hydraulic lines have been omitted for clarity, but generally extend from the engine 28 to hydraulic motors and pistons of the cutting assembly 40, a lift assembly 60 and a slider assembly 70, as well as other hydraulic powered accessories of the cutter 20.

Figure 4:
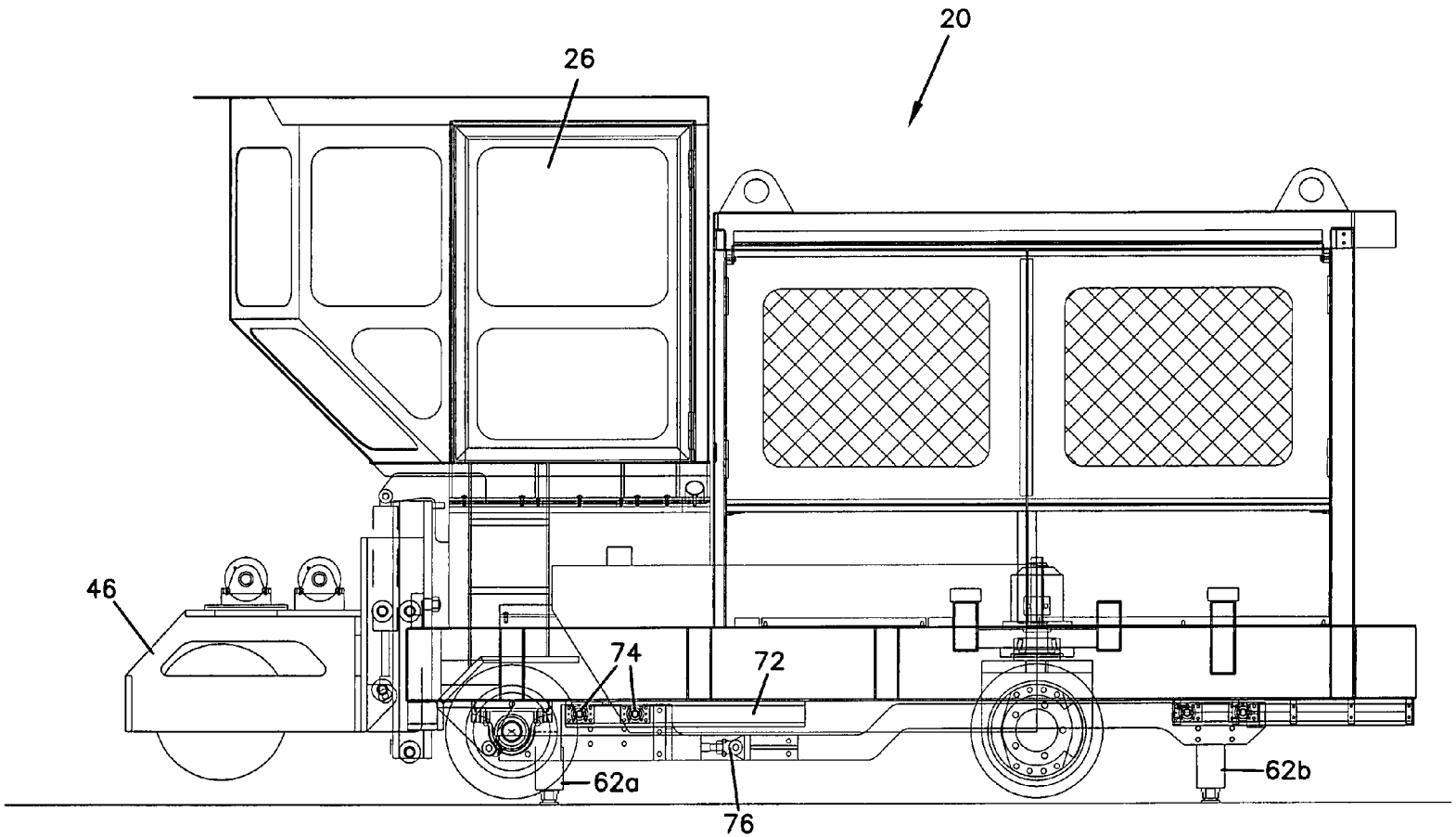
FIG. 4 is a side elevational view of the slot grinding apparatus shown in FIG. 1 with the frame lifted.

When being transported from location to location, the cutter 20 is supported on the wheels 24. The cutter 20 may also cut in a conventional manner while driving on the wheels 24. However, in a typical cutting mode, the lift assembly 60 is actuated to lift the cutter 20 so that it is not supported on the wheels 24, as shown in FIG. 4. Hydraulic cylinders 62A, 62B and 62C serve as legs that are extended to lift the cutter 20, as shown in FIG. 4. When lifted, the cutter 20 does not require a lock and is simply supported on the stationary hydraulic lift legs 62A, 62B and 62C. It can be appreciated that other configurations and lift devices may also be utilized that do not require locking of the cutter 20 and provide a stable guide for the cutter 20 and the blades 42.

Figure 2:
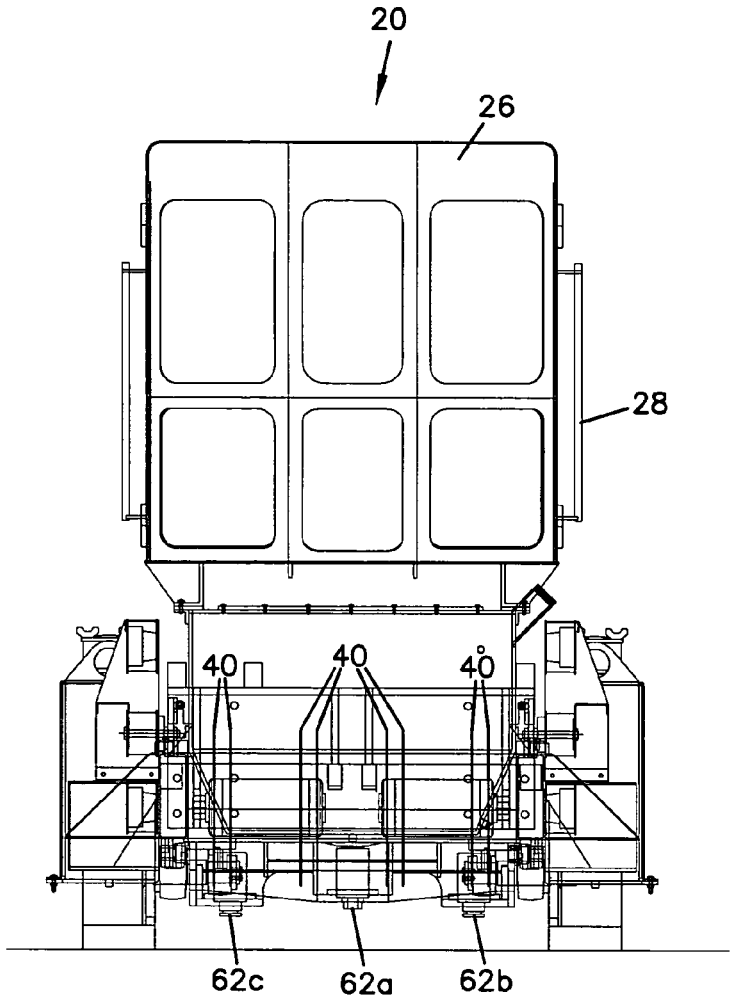
FIG. 2 is a front elevational view of the slot grinding apparatus shown in FIG. 1.
Figure 3:
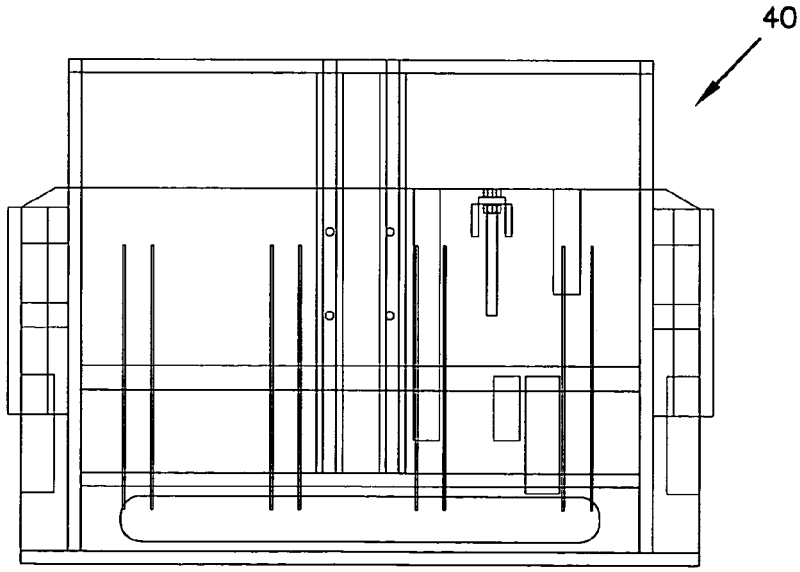
FIG. 3 is a top plan view of the slot grinding apparatus shown in FIG. 1.

Referring to FIGS. 1–3, the cutting assembly 40 includes a plurality of pairs of diamond tipped pavement cutting blades 42 placed in a spaced apart parallel relationship. The blades 42 are arranged in pairs so that each pair of blades 42 cuts the opposed sides of one reinforcement recess in the pavement at the same time. The material between the slots is removed during a later operation in a conventional manner, such as with a jackhammer. In addition, with several sets of blades 42, the recesses are properly spaced at the time of cutting and all of the slots are cut at a load transfer restoration location at the same time, rather than moving the cutting assembly 40 or even moving the entire cutter 20 over to cut multiple slots at a single joint. The cutting assembly 40 includes a housing 46 and hydraulic motors 52 driving the blades 42 through belts, chains or other conventional drives. A depth adjustment 44 includes a hydraulic cylinder 54 to raise and lower the cutting assembly 40 and to adjust depth during cutting.

As shown in FIGS. 1 and 4–6, the slider assembly 70 includes rails 72 and guiding wheels 74 attached to the chassis 22. Hydraulic cylinders 76 extend and retract to move the chassis 22 back and forth relative to the rails 72. Although not locked, the rails 72 remain stationary while supported on the lift legs 62 providing a stable reference position for moving the entire chassis 22 back and forth and therefore, moving the blades 42 back and forth to make elongated cuts. The slider assembly 70 positions the cutter 20 so that the blades 42 are aligned and travel along the same path, thereby making repeatable cuts into the same slots. The present invention moves almost the entire cutter 20, rather than just a cutting carriage. In this manner, the blades 42 have the momentum of the mass of the cutter 20 behind the cuts, rather than just a carriage moving relative to the frame.

It can be appreciated that the lift assembly 60 and the slider assembly 70 provide for forward and back motion, but resist any lateral movement and lateral pressure due to a sloping pavement surface from the typical crown in the road, such as may occur when cutting methods are utilized wherein the entire vehicle is driven back and forth with conventional steering methods.

In operation, the cutter 20 is driven to a position so that the blade assembly 40 is preferably at the rear of a desired location for forming slots in the pavement, as shown in FIG. 1. The blade assembly 40 is not lowered and remains at its raised travel position. The lift assembly legs 62A, 62B and 62C then extend so that the cutter chassis 22 is raised and the entire cutter 20 is supported on the lift assembly 60 and the extended hydraulic lift legs 62A, 62B and 62C, as shown in FIG. 4. Although not locked, the cutter 20 is stationary and cannot roll from this position.

Figure 5:
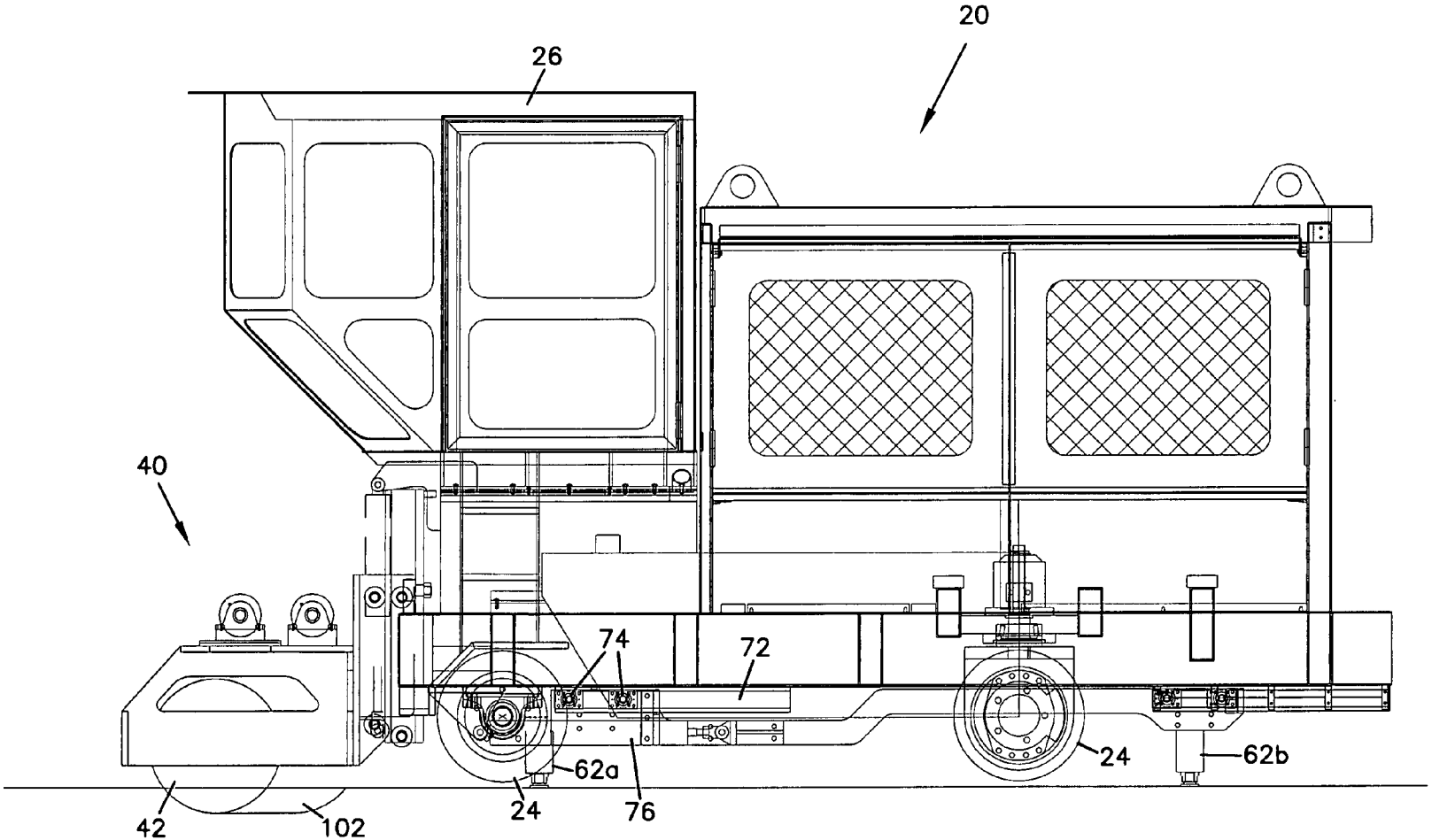
FIG. 5 is a side elevational view of the slot grinding apparatus shown in FIG. 4 with the cutting blades engaging the pavement.

As shown in FIG. 5, with the cutter raised, cutting of the slots begins by lowering the cutting assembly 40 to engage the pavement. In this position, the blades 42 are cutting into the pavement and forming slots. It can be appreciated that the depth adjustment 44 must be able to apply sufficient downward pressure on the blades 42 to achieve satisfactory cutting action. The portion of the blades 42 engaging the pavement typically has a contact length less than the desired length of the slots. Therefore, the blades 42 must be moved back and forth to cut slots of the proper length.

Figure 6:
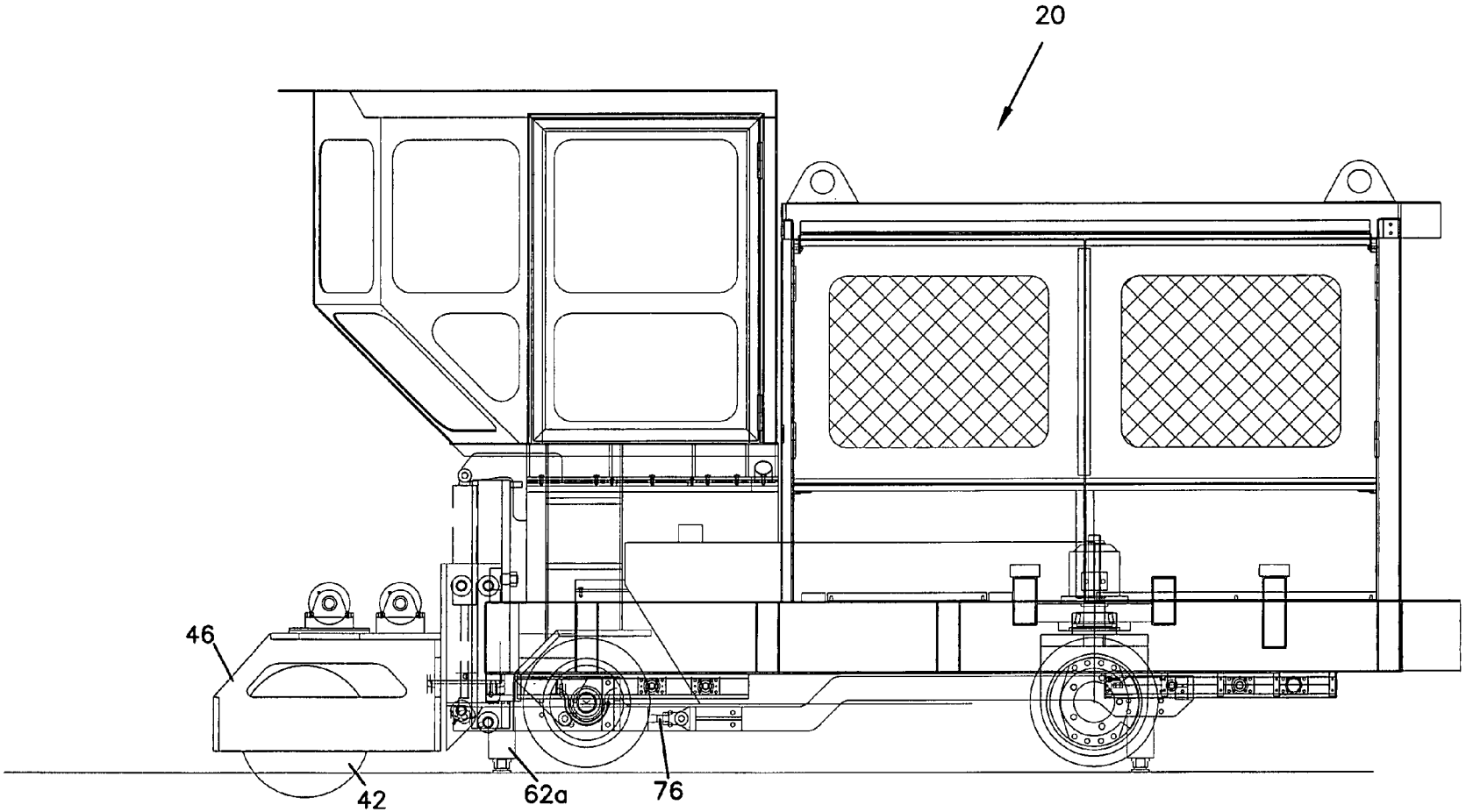
FIG. 6 is a side elevational view of the slot grinding apparatus shown in FIG. 4 with the cutting blades engaging the pavement and the frame sliding forward during a cut.

As shown in FIG. 6, the slider assembly 70 is actuated by extending the hydraulic cylinder 76 and pushing the chassis 22, and therefore the cutting assembly 40 and the blades 42, forward. This forward movement occurs while the blades 42 are cutting into the pavement. In this manner, the slots are extended forward until reaching their predetermined length. It can be appreciated that the length of the slots can be varied by controlling the extension and retraction of the hydraulic cylinder 76. In addition, the position of the front and back edges of the slots may be varied slightly by controlling the position at which the cut begins through retraction or extension of the hydraulic cylinder 76. This additional adjustment requires less precision by the operator when positioning the cutter 20 prior to cutting.

Depending upon cutting conditions, such as pavement characteristics, it may not be possible to cut the slots to the desired depth in one pass. Therefore, it may be necessary to cut at a first depth with a first pass, lower the cutting assembly 40 to a lower depth with the blades 42 cutting deeper and making an additional pass or additional passes. It can be appreciated that the length of the slot may be repeated with the present invention as the hydraulic cylinder 76 prevents coasting beyond the stop point. Moreover, the cab 26 has viewing windows 34 that allow the operator to clearly view the entire cutting operation. In addition, the cutter controls may be programmed to precisely repeat the cut. The controls also allow the operator to vary the length and depth of the cut and match the needs of the particular load restoration project. It can be appreciated that for some cutting conditions, cutting may only be possible while moving the blades 42 forward and therefore, moving the entire cutter 20 forward. However, in other cutting operations, it may be possible to cut while moving forward as well as moving backward.

When cutting the slots 102 with the cutter 20 is finished, the cutting assembly 40 is simply raised by retracting the depth control hydraulic cylinder 54. The lift assembly 60 is disengaged by retracting the lift legs 62A, 62B and 62C so that the cutter 20 is again supported on the wheels 24, as shown in FIG. 1. The cutter 20 is then driven to the next joint in the road and slot cutting for the load restoration process is repeated. The cutter 20 provides for cutting at a faster rate with quicker alignment than is provided for by the prior art. In addition, multiple pairs of slots are easily cut at the same time.

When the slots 102 have been cut, the material between each slot pair is removed to form the recesses 100 and the reinforcement devices 110 are placed in the recesses 100, as shown in FIG. 7. The recesses 100 are filled in again to provide for repair and reinforcement of the pavement joints along the road and maintaining a level road surface.

The present invention provides advantages for slot depth, length and repeatability through the hydraulic controls that prevent coasting beyond predetermined points. The present invention also overcomes the problems with the prior art relating to slot quality and wear from lateral pressure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An apparatus for cutting slots in pavement, comprising:

a vehicle having:

drive wheels;

a slot cutting assembly mounted to the vehicle and vertically adjustable relative to the vehicle;

a lift for moving the vehicle between a first position wherein the lift is not engaging the ground and a second position wherein the lift engages the ground and the drive wheels are disengaged; and a slider for moving the vehicle horizontally relative to the lift when the vehicle is at the second position.

2. An apparatus according to claim 1, wherein the slider comprises at least one rail.

3. An apparatus according to claim 1, wherein the vehicle includes a motive system supporting the vehicle at the first position.

4. An apparatus according to claim 1, wherein the cutting assembly comprises a plurality of rotating blades.

5. An apparatus according to claim 3, wherein the motive system comprises a plurality of wheels.

6. An apparatus according to claim 2, wherein the slider comprises a hydraulic ram controlling motion along the slider rail.

7. An apparatus according to claim 2, wherein the slider includes slider wheels rolling on the rail.

8. An apparatus according to claim 2. wherein the slider comprises a plurality of rails.

9. An apparatus according to claim 1, wherein the cutting assembly includes a plurality of spaced-apart blade pairs.

10. An apparatus according to claim 9, wherein the blade sets have varied travel distance.

11. An apparatus according to claim 9, wherein the blade sets are configured for cutting slots of different lengths.

12. An apparatus according to claim 9, wherein the blade sets are configured for cutting increasing slot lengths from a first side to a second side.

13. An apparatus for cutting slots in pavement, comprising:

a vehicle having a motive system;

a slot cutting assembly mounted to the vehicle and vertically adjustable relative to the vehicle;

a lift for moving the vehicle between a first position wherein the vehicle is supported on the motive system, and a second position wherein the vehicle is supported on the lift; and a slider for moving the vehicle horizontally relative to the lift when the vehicle is at the second position.

* * * * *